US010753017B2

(12) United States Patent
Sinykin

(10) Patent No.: US 10,753,017 B2
(45) Date of Patent: Aug. 25, 2020

(54) INSULATING FABRIC AND METHOD FOR MAKING THE SAME

(71) Applicant: Daniel L. Sinykin, Bayside, WI (US)

(72) Inventor: Daniel L. Sinykin, Bayside, WI (US)

(73) Assignee: Siny Corp., Janesville, WI (US)

( * ) Notice: Subject to any disclaimer, the term of this patent is extended or adjusted under 35 U.S.C. 154(b) by 90 days.

(21) Appl. No.: 15/749,682

(22) PCT Filed: Aug. 2, 2016

(86) PCT No.: PCT/US2016/045151
§ 371 (c)(1),
(2) Date: Feb. 1, 2018

(87) PCT Pub. No.: WO2017/023924
PCT Pub. Date: Feb. 9, 2017

(65) Prior Publication Data

US 2018/0223459 A1 Aug. 9, 2018

Related U.S. Application Data

(60) Provisional application No. 62/201,002, filed on Aug. 4, 2015.

(51) Int. Cl.
*D04B 1/02* (2006.01)
*D04B 1/24* (2006.01)

(52) U.S. Cl.
CPC ..... *D04B 1/025* (2013.01); *D04B 1/24* (2013.01); *D10B 2403/0111* (2013.01)

(58) Field of Classification Search
CPC . D04B 1/025; D04B 1/24; D04B 1/02; D04B 9/12; D04B 9/14; D04B 11/08
See application file for complete search history.

(56) References Cited

U.S. PATENT DOCUMENTS 4,678,693 A 7/1987 Kemp
4,712,281 A * 12/1987 Scheller ..... D04B 21/02 28/162
4,797,311 A 1/1989 Kemp
5,312,667 A * 5/1994 Lumb ..... D04B 1/24 428/91

(Continued)

FOREIGN PATENT DOCUMENTS

CN 102418225 A 4/2012
CN 202775425 U 3/2013

(Continued)

*Primary Examiner* — Danny Worrell
(74) *Attorney, Agent, or Firm* — Reinhart Boerner Van Deuren P.C.

(57) ABSTRACT

A sliver-knit insulating fabric is disclosed that has pile extending from both sides of a knitted base material with the insulating fabric having a weight per unit area of less than 200 g/m2. The pile is formed from a plurality of tufts of fibers secured within the knitted base material. The tufts of fibers define a plurality of end portions extending from the knitted base material with a first portion of the end portions extending from a first side of the knitted base material to form a first pile portion and a second portion of the end portions extending from a second side of the knitted base material to form a second pile portion. A method of forming the sliver-knit insulating fabric is also disclosed.

20 Claims, 4 Drawing Sheets

(56) References Cited

U.S. PATENT DOCUMENTS 5,718,972 A 2/1998 Murase et al.
5,795,835 A 8/1998 Bruner et al.
5,855,125 A * 1/1999 Lohmueller ..... D04B 21/02 28/162
6,020,275 A 2/2000 Stevenson et al.
6,056,479 A 5/2000 Stevenson et al.
6,837,078 B1 * 1/2005 Rock ..... D04B 21/04 66/195
7,743,476 B2 * 6/2010 Rock ..... D04B 1/02 2/69
RE41,574 E 8/2010 Rock et al.
7,829,172 B2 11/2010 Rock et al.
7,926,307 B1 * 4/2011 Williams ..... D04B 1/02 66/194
8,129,296 B2 3/2012 Rock et al.
2002/0197442 A1 * 12/2002 Wyner ..... A47G 9/0223 428/85
2004/0099019 A1 * 5/2004 Sasser ..... A44B 18/0034 66/195
2004/0132367 A1 * 7/2004 Rock ..... A41D 3/005 442/76
2005/0109069 A1 * 5/2005 Yamaguchi ..... D04B 1/02 66/202
2006/0277950 A1 * 12/2006 Rock ..... A41D 13/002 66/169 R
2008/0265468 A1 * 10/2008 Sinykin ..... B05C 17/0207 264/345
2009/0019614 A1 * 1/2009 Hagihara ..... A41D 19/01529 2/16
2009/0170677 A1 * 7/2009 Knight, Sr. ..... B05C 17/0207 492/29
2009/0183817 A1 * 7/2009 Sinykin ..... B05C 17/0207 156/86
2011/0296875 A1 * 12/2011 Tokumoto ..... D04B 1/02 66/194
2013/0183495 A1 7/2013 Rock
2013/0196109 A1 8/2013 Rock et al.
2014/0115783 A1 * 5/2014 Rock ..... A47G 9/0223 5/502
2014/0237747 A1 * 8/2014 Torri ..... D04B 21/04 15/207.2
2015/0104604 A1 * 4/2015 Rock ..... B32B 27/08 428/86
2015/0173440 A1 * 6/2015 Rock ..... A41D 31/0038 428/76
2017/0226668 A1 * 8/2017 Kilickan ..... D03D 3/08
2018/0071423 A1 * 3/2018 Miyamura ..... B01J 20/10
2018/0223459 A1 * 8/2018 Sinykin ..... D04B 1/025
2019/0281909 A1 * 9/2019 Rock ..... B32B 5/26

FOREIGN PATENT DOCUMENTS

CN 103789918 A 5/2014
JP 03124857 A 5/1991
JP 04240252 A 8/1992
JP 2006037302 A 2/2006

* cited by examiner

INSULATING FABRIC AND METHOD FOR MAKING THE SAME

FIELD OF THE INVENTION

This invention generally relates to fabrics and more particularly to knit insulating fabrics.

BACKGROUND OF THE INVENTION

Many prior art fabrics have been used for thermal insulation such as in clothing. In clothing, an insulating material may be enclosed between two or more fabric layers. The outer fabric layers can provide additional benefits such as, but not limited to, being visually appealing, breathable, fire retardant, water repellant or resistant or wind resistant.

Known insulating fabrics suffer from numerous downfalls such as being inconsistent, they may penetrate through the outer layers of the clothing, the insulating material may shed from a base fabric, the insulating fabric may provide inconsistent insulation, the insulating material may degrade or fall apart over time, and/or the insulating fabric may need to be quilted to one or more of the outer layers to keep the insulating fabric in the proper location relative to the outer layers.

These problems are particularly apparent when using yarn based insulating fabrics where the knitted yarn is degraded to form pile out of the yarn itself or from down or fiberfill based insulating fabrics.

The invention provides improvements over the current state of the art of insulating fabrics to provide improved thermal insulation values, dimensional stability, lower weight per unit area, more consistent weight throughout the fabric, etc. These and other advantages of the invention, as well as additional inventive features, will be apparent from the description of the invention provided herein.

BRIEF SUMMARY OF THE INVENTION

In one embodiment, a sliver-knit insulating fabric includes a knitted base material and a plurality of tufts of fibers. The tufts of fibers are secured within the knitted base material. The tufts of fibers define a plurality of end portions extending from the knitted base material. A first portion of the end portions extend from a first side of the knitted base material to form a first pile portion and a second portion of the end portions extend from a second side of the knitted base material to form a second pile portion. The knitted base material and plurality of tufts of fibers have a combined weight per unit area of less than 200 g/m$^2$.

In one embodiment, a ratio of the weight of the first portion of the end portions to the weight of the second portion of the end portions is between 1:1 and 2.5:1.

In a more particular embodiment, a ratio of the weight of the first portion of the end portions to the weight of the second portion of the end portions is between 1.75:1 and 2.25:1.

In one embodiment, the knitted base material is a low melt yarn.

In one embodiment, the tufts of fibers are formed from a low denier fiber.

In one embodiment, the combined weight per unit area varies less than plus or minus 15% per square inch such that consistency in the material is high.

In one embodiment, a quantity of end portions of the first portion of the end portions is greater than a quantity of end portions of the second portion of the end portions.

In one embodiment, an average length of the end portions of the first portion of end portions is greater than an average length of the end portions of the second portion of end portions.

In one embodiment, the knitted base material has a predetermined number of wales adjacent each other and successive courses each of which is knit after a preceding course. Each wale comprises a plurality of loops. Each loop in any particular wale is knitted through a loop in the preceding course in said particular wale. Each of said tufts of fibers has a loop portion located between the end portions. The loop portion of each of said plurality of tufts is knitted together with a loop of said base fabric into said base fabric.

In one embodiment, the plurality of tufts of fibers forms between about 20% and 80% of the sliver-knit insulating material by weight.

In one embodiment, a method of forming a sliver-knit insulating fabric is provided. The method includes knitting a knitted base material with a plurality of tufts of fibers such that the plurality of tufts of fibers are secured within the knitted base material, such that the knitted base material and plurality of tufts of fibers have a combined weight per unit area of less than 200 g/m$^2$. Knitting includes defining a plurality of end portions of the tufts of fibers with the plurality of end portions extending from the knitted base material. The method further includes forming a first portion of the end portions that extend from a first side of the knitted base material to form a first pile portion and a second portion of the end portions that extend from a second side of the knitted base material to form a second pile portion.

In one method, the step of forming includes napping the knitted base material and plurality of tufts of fibers.

In one method, napping includes pulling one of the first or second portion of the end portions through the knitted base material.

In one method, a ratio of the weight of the first portion of the end portions to the weight of the second portion of the end portions is between 1:1 and 2.5:1.

In one method, a ratio of the weight of the first portion of the end portions to the weight of the second portion of the end portions is between 1.75: and 2.25:1.

In one method, the knitted base material is a low melt yarn.

In one method, the tufts of fibers are formed from a low denier fiber.

In one method, the combined weight per unit area varies less than plus or minus 15% per square inch.

In one method, a quantity of end portions of the first portion of the end portions is greater than a quantity of end portions of the second portion of the end portions.

In one method, an average length of the end portions of the first portion of end portions is greater than an average length of the end portions of the second portion of end portions.

In one method, the knitted base material has a predetermined number of wales adjacent each other and successive courses each of which is knit after a preceding course. Each wale comprises a plurality of loops. Each loop in any particular wale is knitted through a loop in the preceding course in said particular wale. Each of said tufts of fibers has a loop portion located between the end portions. The loop portion of each of said plurality of tufts is knitted together with a loop of said base fabric into said base fabric.

In one method, the plurality of tufts of fibers forms between about 20% and 80% of the sliver-knit insulating material by weight.

In one method, the method further includes heating the knitted base material and tufts of fibers after the step of forming so as to heat-set the knitted base material and tufts of fibers.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Embodiments of the present invention relate to a lightweight fiber based insulating fabric formed using a sliver-knitting process.

Figure 1:
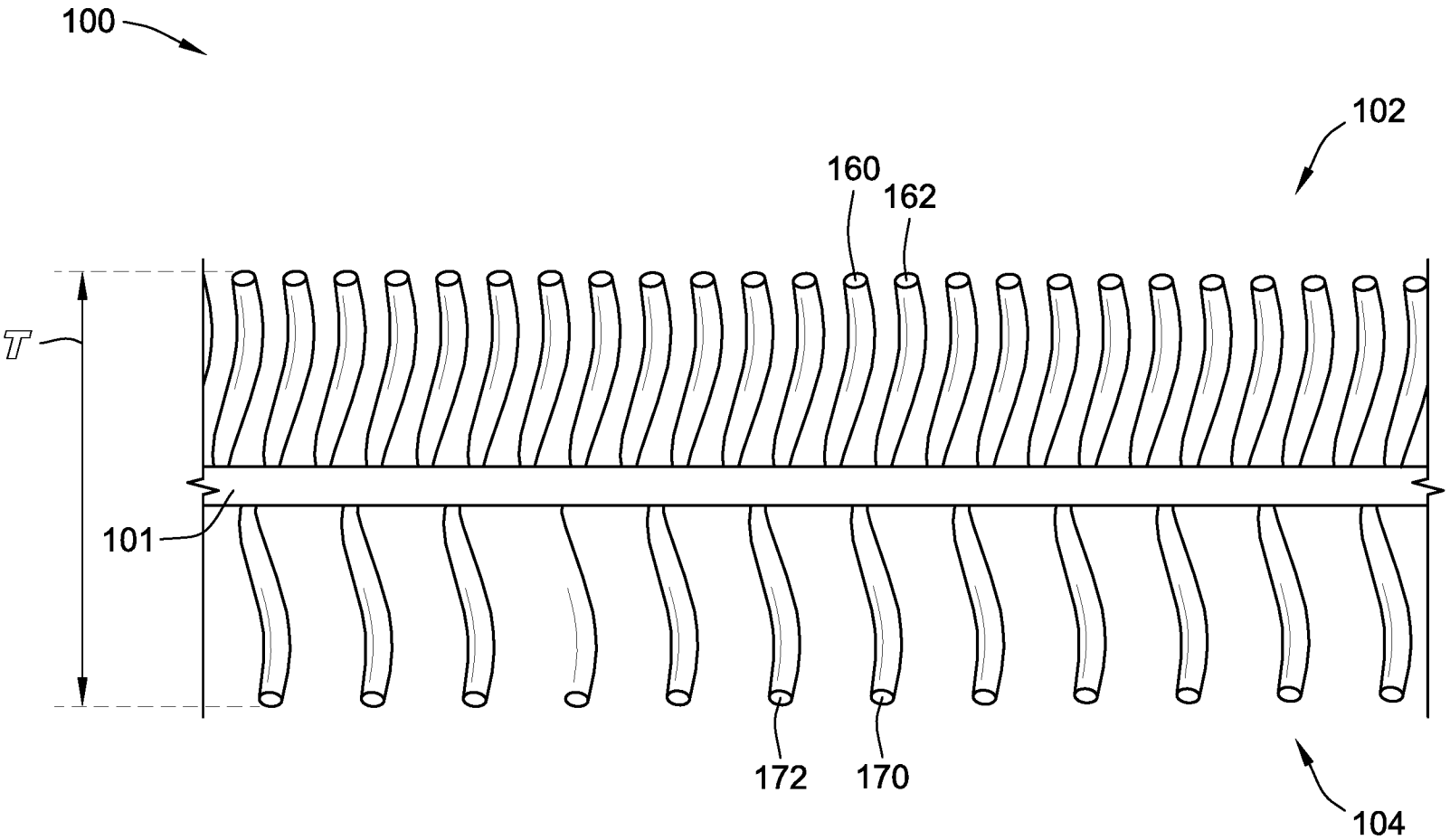
FIG. 1 is a simplified side view of an insulating material according to an embodiment of the invention.

FIG. 1 is a schematic representation of an insulating fabric 100 according to an embodiment of the present invention. The insulating fabric 100 is designed to be used between at least two outer layers of shell material, which may or may not be the same, to provide a thermal insulating layer between the at least two outer layers.

To provide thermal insulating characteristics, the insulating fabric 100 includes a base material 101 and a plurality of pile fibers having end portions extending from the base material 101 forming first and second pile portions 102, 104 on opposite sides of the base material 101. The pile portions 102, 104 are secured to the base material 101 to prevent shedding and migration of the fibers that form the pile portions 102, 104.

In a preferred embodiment, the insulating fabric 100 is formed using a sliver-knitting process to secure the fibers that form the pile portions 102, 104 to the base material 101. In particular, the sliver-knitting process may be a circular knitting process. The resulting tube of knitted fabric will be cut such that the tube of knitted fabric can be unfolded to a flat sheet.

In some embodiments and as illustrated in FIG. 1, one of the pile portions such as the first pile portion 102 in the illustrated embodiment may include more fiber than the second pile portion 104. In some embodiments, the ratio of the first pile portion 102 to the second pile portion 104 by weight is 2.5:1 to 1:1 and more preferably between 2:25:1 to 1.75:1 and most preferably about 2:1 within about 5%.

Figure 2:
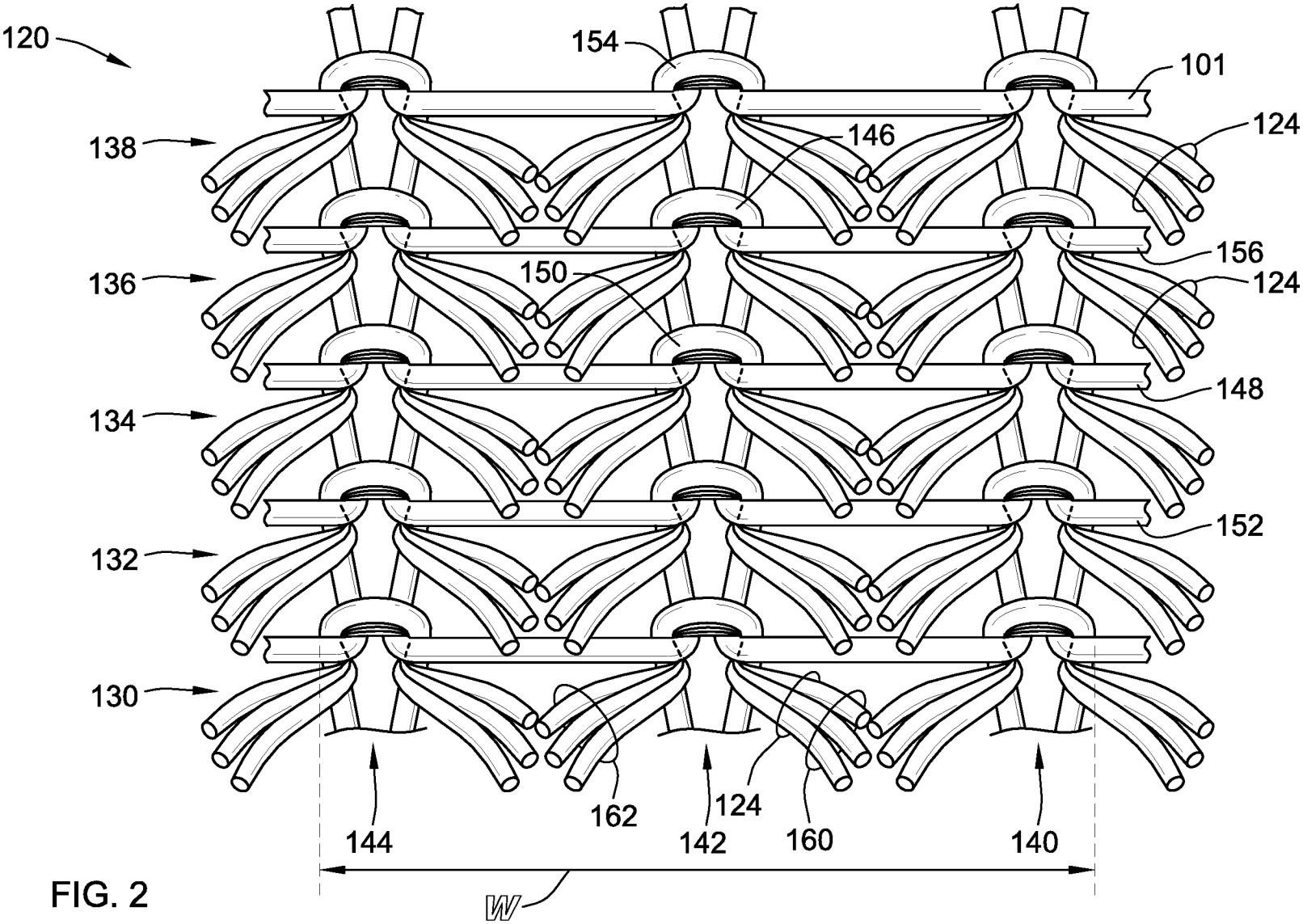
FIG. 2 is a simplified schematic illustration of the insulating material after sliver-knitting and prior to napping.

A simplified illustration of a sliver-knit segment of the insulating fabric 100 is illustrated in FIG. 2. The insulating fabric 100 may be continuously knitted in an extended length. The sliver-knit segment includes knit backing or base material 101 having tufts of pile fibers knitted therein as illustrated in FIG. 2. In FIG. 2, all of the free ends of the pile fibers are generally located on a same side of the base material 101.

Figure 3:
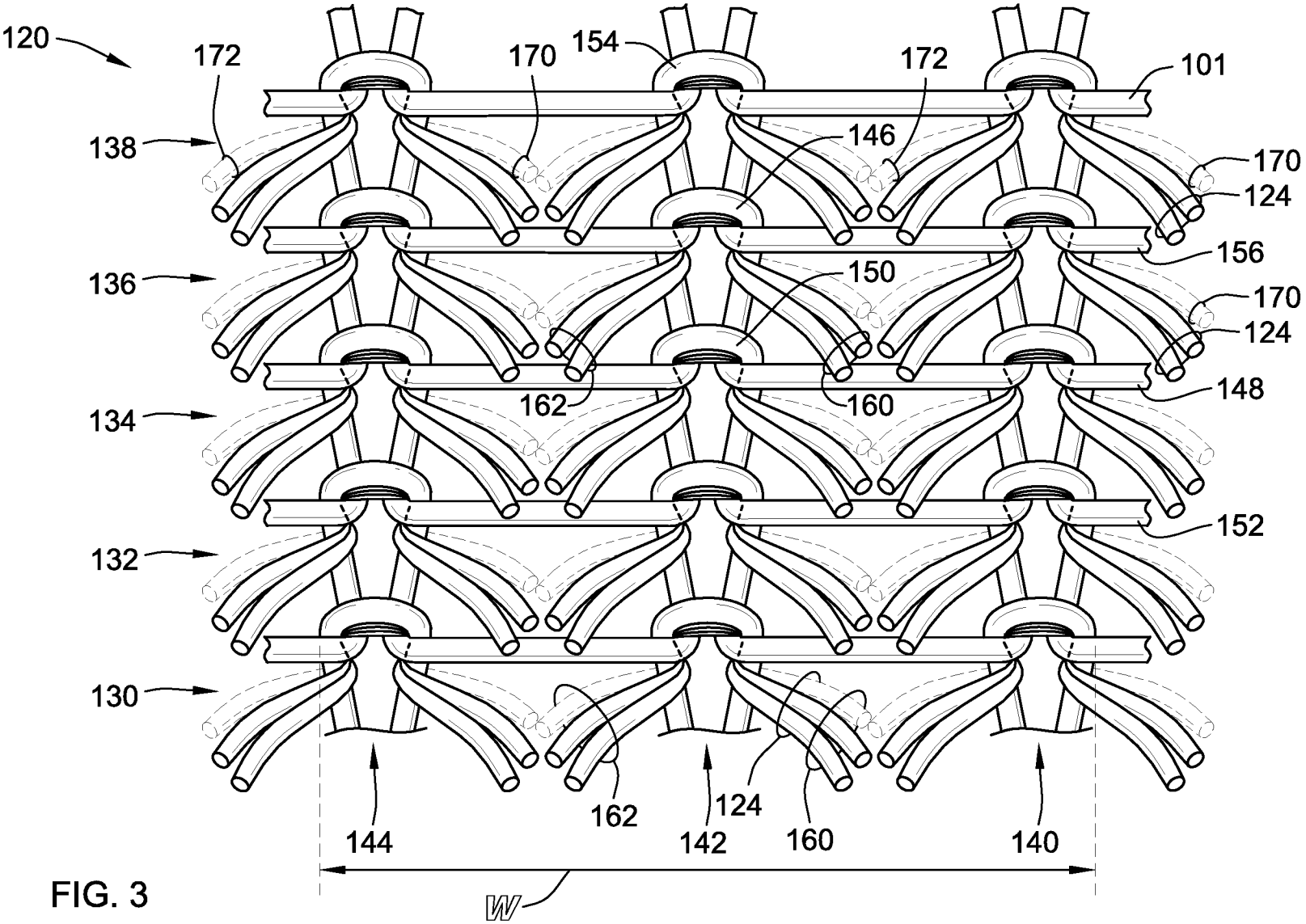
FIG. 3 is a simplified schematic illustration of the insulating material after napping.

Thereafter, the formed insulating fabric 100 will be subjected to a napping process that pulls a portion of the tufts of pile fibers to the opposite side of the base material 101 such that the resulting material has pile on both sides of the base material 101 as illustrated in FIG. 3.

The initial process of sliver-knitting the insulating fabric 100 will be described with reference to FIG. 2.

A segment 120 of the tubular sliver-knit insulating fabric is shown in schematic form from the inside of the tube of material as it is being formed to illustrate the knit of the base material 101, and the manner in which tufts of the pile fibers 124 are woven into the knit base material 101. Those skilled in the art will at once realize that while the tufts of the pile fibers 124 shown in FIG. 2 include only a few fibers each for added clarity and understanding of the construction of the fabric, tufts of the pile fibers 124 in the tubular sliver-knit segment 120 will actually include sufficient pile fibers 124 to make a pile that is sufficiently dense for the intended use of the tubular sliver-knit segment 120 as a lightweight insulation.

The foundation of the sliver-knit segment 120 is the knit base material 101. The knit base material 101 has a plurality of courses (which are rows of loops of stitches which run across the knit fabric), five of which are shown and designated by the reference numerals 130, 132, 134, 136, and 138, and a plurality of wales (which are vertical chains of loops in the longitudinal direction of the knit fabric), three of which are shown and designated by the reference numerals 140,142, and 144. The respective courses 130, 132, 134, 136, and 138 are knitted sequentially from the lowest course number to the highest course number.

By way of example, the construction of the portion of the tubular sliver-knit segment 120 in the area of the course 136 and the wale 142 will be discussed herein. A loop 146 formed in a yarn segment 148 is located in this area, with a loop 150 formed in a yarn segment 152 being located in the course 134 below the loop 146, and a loop 154 formed in a yarn segment 156 being located in the course 138 above the loop 146. The loop 146 extends through the loop 150 from the inside to the outside of the tubular sliver-knit segment 120 (shown in FIG. 2), and the loop 154 also extends through the loop 146 from the inside to the outside.

A tuft of pile fibers 124 having a loop portion 158 and opposite end portions 160 and 162 is knitted into the knit base material 101 together with the loop 146. The loop portion 158 of that particular tuft of pile fibers 124 is located adjacent the top of the loop 146, and the opposite end portions 160 and 162 of that particular tuft of pile fibers 124 extend inwardly from the exterior of the loop 146, above the loop 150 and below the loop 154. In a similar manner, each of the other tufts of the pile fibers 124 is knitted into the knit base material 101 with a different loop.

After the knitting process, the tubular sliver knit segment 120 is slit down a side such that the material can lay flat.

Thereafter, the sliver-knit segment 120 is subjected to a shearing and napping process. The napping process uses a plurality of wires having a hooked end to pull a portion of the tuft of pile fibers 124 from the current side, i.e. inside, to the opposite, i.e. outside, of the knit base material 101. Prior to the napping, all of the opposite end portions 160, 162 of the tuft of pile fibers 124 are located on the same side of the base material 101.

However, as illustrated in FIG. 3, after the napping process, some of the end portions (having newly assigned reference characters 170, 172 and illustrated in dashed lines) are located on the opposite side, i.e. outside, of the base material 101 as they have been pulled through the base material 101.

The napping process pulls on the material such that the width W of the material will shrink laterally, e.g. perpendicular to the direction of formation and generally parallel to the courses 130, 132, 134, 136, 138. As such, after napping, the material may be stretched to its desired width W and then passed through an oven to be heat-set.

Further, the material may be subjected to a shearing process to cut the end portions 160, 162, 170, 172 are trimmed to a uniform desired pile height. The end portions 160, 162, 170, 172 are trimmed such that the first and second pile portions 102, 104 are of a desired height such that a desired thickness T (FIG. 1) of the product can be produced. The shearing process will typically occur prior to the napping process but can be performed subsequent to the shearing process for some embodiments, such as when end portions 160, 162 have a different length than end portions 170, 172 in the finished fabric.

The ratios above can be created by making adjusting the number or density of end portions 160, 162, 170, 172 present on a given side of the base material 101, varying the length of the end portions 160, 162, 170, 172 on a given side of the base material or a combination thereof. The number of end portions 160, 162, 170, 172 on a given side of the base material 101 can be modified by modifying the napping process. The length of the end portions 160, 162, 170, 172 on a given side of the base material can be varied by varying the shearing process.

In a preferred embodiment, the insulating fabric 100 is a low weight fiber based insulating material rather than a yarn based insulating material. As used herein, a fiber based insulating material forms the piles from separate fibers, e.g. the tuft of pile fibers 124 discussed above, secured to the knit base material 101. This is unlike a yarn based insulating material where the surfaces of the yarn forming the base material are abraded such that the yarn forming the base material provides the pile.

By using this fiber based insulating material over a yarn based insulating material or down based insulating material, the insulating fabric 100 over comes many of the problems outlined above while remaining low weight.

Preferably, the insulating material has a weight per unit area of between about 50 g/m$^2$ to about 200 g/m$^2$. More preferably, the weight per unit area is between about 70 g/m$^2$ to about 175 g/m$^2$. Even more preferably, the weight per unit area is less than 150 g/m$^2$. However, as embodiments of the insulating material have high levels of consistency, variation of weight per unit area will preferably not exceed plus or minus 15% per square inch and more preferably will not exceed plus or minus 10% per square inch and even more preferably will not exceed plus or minus 8% per square inch. In other words, a given square inch will not have a density that varies by more than the identified percentage from the density for a given square meter.

In a preferred embodiment, the pile fibers 124 are formed from various low denier fiber. In some implementations, the pile fibers 124 are between 0.8 denier and 8 denier and more preferably between 0.9 denier and 6 denier. In one example, the conjugated low denier fiber could be 100% 40 gram polyester. One of the advantages of the sliver knit insulation and methods over yarn based insulation is that blends of different fiber types and denier values can be achieved with consistency and optimized performance. For instance, materials such as polyester, nylon, rayon, wool, etc. may be used. Further, fibers can be treated to improve or achieve additional benefits such as being, for example, flame retardant, anti-microbial, etc.

Preferably, the pile fibers 124 make up at least 20% and less than 80% by weight of the resulting insulating fabric 100. More preferably, the pile fibers 124 make up at least 25% by weight of the resulting insulating fabric 100.

To form the low weight insulating fabric 100 described herein, it was found that a low grain weight roving (also known as sliver) is used. Preferably, the roving from which the tufts of fiber pile 124 are taken during the sliver-knitting process has a grain weight of less than 200 g/m and greater than 10 g/m.

Further, the pile fibers are preferably less than 3 inches prior to being sliver-knit with the base material 101, i.e. while forming part of the sliver (also referred to as a roving) prior to the sliver-knitting process. In some embodiments the pile fibers 124 are less than 2 inches. The pile fibers 124 will typically be greater than ⅜ inch in length prior to knitting and even more typically greater than ½ inch.

The insulating material 100 will have a pile fiber density, on average, of between 10 g/m$^2$ and 160 g/m$^2$.

The knit base material may be a bicomponent low melt yarn.

The yarn used for the knit base material 101 preferably has a denier value of between 0.9 and 15 and more preferably between 3 and 6. The yarn for the knit base material 101 preferably has a gauge of between 25 d and 300 d and more preferably between 100 d and 200 d.

In an embodiment, the resulting insulating material will have dimensional stability and will not stretch more than 15% in any direction and more preferably not more than 5% in any direction.

Figure 4:
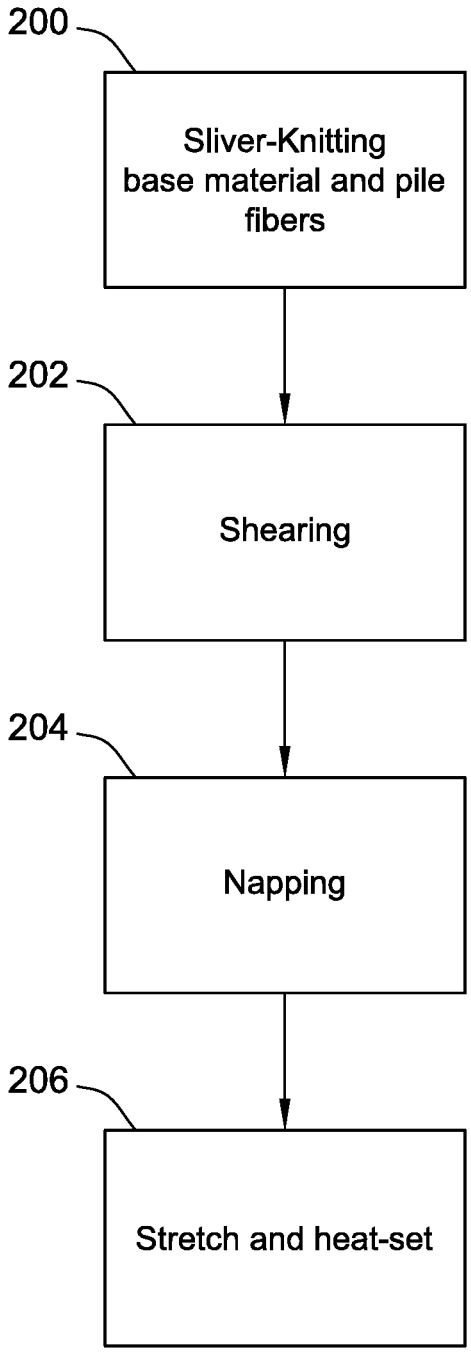
FIG. 4 is a simplified flow chart illustrating the process of forming the insulating material of FIG. 1.

A method of forming the insulating fabric 100 is shown in schematic form in FIG. 4. The method generally includes circular sliver-knitting 200 the pile fibers 124 with the base material 101. The tube of material formed during circular sliver-knitting 200 will be slit to form a flat product.

The fabric as illustrated in FIG. 2 will sheared 202 after the circular sliver-knitting 200. The end portions 160, 162, 170, 172 will be sheared 202 to a desired length such that the resulting product will form a desired thickness T. The shearing process may remove 0 g/m$^2$ and 150 g/m$^2$ of pile fiber 124.

This product will then be napped 204 to form pile portions 102, 104 on both sides of the base material 101. Napping 204 will typically include pulling a portion of the end portions 160, 162, 170, 172 which are all located on a same side of base material 101 as illustrated in FIG. 2 to the opposite side of the base material 101 to form the fabric as illustrated in FIG. 3. Typical napping 204 uses a plurality of wires that have hooked ends that penetrate through the base material 101 and pull selected ones of the end portions back through the base material 101 to form a second pile portion on the opposite side of the base material 101.

After napping 204, the sheared and napped product will be stretched and then heat cured 206 to form the final insulating material 100 of a desired width W. Depending on the product and the heat of the heat curing, heat curing can take varying amounts of time. However, in a preferred method, the heat curing will occur at between 250° F. and 350° F. In some preferred methods, the heat curing will not cause any melting of the different materials forming the fabric and particularly the outer surface of the base material or fibers.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sliver-knit insulating fabric comprising:

a knitted base material;

a plurality of tufts of fibers secured within the knitted base material, the tufts of fibers defining a plurality of end portions extending from the knitted base material, a first portion of the end portions extending from a first side of the knitted base material to form a first pile portion and a second portion of the end portions extending from a second side of the knitted base material to form a second pile portion;

the knitted base material and plurality of tufts of fibers having a combined weight per unit area of less than 200 $g/m^2$;

the knitted base material has a plurality of wales adjacent each other and successive courses each of which is knit after a preceding course, each wale comprising a plurality of loops, wherein each loop in any particular wale is knitted through a loop in the preceding course in said particular wale;

each of said tufts of fibers forms a loop portion, said loop portion of each tuft of fibers being located between the end portions of said tufts of fibers;

each loop of knitted base material having a corresponding one of the tufts of fibers of the plurality of tufts of fibers being secured within the knitted base material at said loop; and wherein the corresponding one of the tufts of fibers at one loop in the knitted base material does not extend through the loop portion of a corresponding one of the tufts of fibers at another loop in the knitted base material.

2. The sliver-knit insulating fabric of claim 1, wherein a ratio of the weight of the first portion of the end portions to the weight of the second portion of the end portions is between 1:1 and 2.5:1.

3. The sliver-knit insulating fabric of claim 1, wherein a ratio of the weight of the first portion of the end portions to the weight of the second portion of the end portions is between 1.75:1 and 2.25:1.

4. The sliver-knit insulating fabric of claim 1, wherein the tufts of fibers are between 0.8 and 8 denier.

5. The sliver-knit insulating fabric of claim 1, wherein the combined weight per unit area varies less than plus or minus 15% per square inch.

6. The sliver-knit insulating fabric of claim 2, wherein a quantity of end portions of the first portion of the end portions is greater than a quantity of end portions of the second portion of the end portions.

7. The sliver-knit insulating fabric of claim 2, wherein an average length of the end portions of the first portion of end portions is greater than an average length of the end portions of the second portion of end portions.

8. The sliver-knit insulating fabric of claim 1, wherein the plurality of tufts of fibers forms between about 20% and 80% of the sliver-knit insulating material by weight.

9. A method of forming a sliver-knit insulating fabric of claim 1, comprising the steps of:

knitting a knitted base material with a plurality of tufts of fibers such that the plurality of tufts of fibers are secured within the knitted base material, such that the knitted base material and plurality of tufts of fibers have a combined weight per unit area of less than 200 $g/m^2$, knitting includes:

defining a plurality of end portions of the tufts of fibers with the plurality of end portions extending from the knitted base material;

forming a first portion of the end portions extending from a first side of the knitted base material to form a first pile portion and a second portion of the end portions extending from a second side of the knitted base material to form a second pile portion;

wherein the knitted base material has a plurality of wales adjacent each other and successive courses each of which is knit after a preceding course, each wale comprising a plurality of loops, wherein each loop in any particular wale is knitted through a loop in the preceding course in said particular wale;

each of said tufts of fibers forms a loop portion, said loop portion of each tuft of fibers being located between the end portions of said tufts of fibers;

each loop of knitted base material having a corresponding one of the tufts of fibers of the plurality of tufts of fibers being secured within the knitted base material at said loop; and wherein the corresponding one of the tufts of fibers at one loop in the knitted base material does not extend through the loop portion of a corresponding one of the tufts of fibers at another loop in the knitted base material.

10. The method of claim 9, wherein the step of forming includes napping the knitted base material and plurality of tufts of fibers.

11. The method of claim 10, wherein napping includes pulling one of the first or second portion of the end portions through the knitted base material.

12. The method of claim 9, wherein a ratio of the weight of the first portion of the end portions to the weight of the second portion of the end portions is between 1:1 and 2.5:1.

13. The method of claim 9, wherein a ratio of the weight of the first portion of the end portions to the weight of the second portion of the end portions is between 1.75:1 and 2.25:1.

14. The method of claim 9, wherein the tufts of fibers are fibers are between 0.8 and 8 denier.

15. The method of claim 9, wherein the combined weight per unit area varies less than plus or minus 15% per square inch.

16. The method of claim 12, wherein a quantity of end portions of the first portion of the end portions is greater than a quantity of end portions of the second portion of the end portions.

17. The method of claim 12, wherein an average length of the end portions of the first portion of end portions is greater than an average length of the end portions of the second portion of end portions.

18. The method of claim 9, wherein the plurality of tufts of fibers forms between about 20% and 80% of the sliver-knit insulating material by weight.

19. The method of claim 9, further comprising heating the knitted base material and tufts of fibers after the step of forming so as to heat-set the knitted base material and tufts of fibers.

20. The sliver-knit insulating fabric of claim 1, wherein each loop of the knitted base material and the loop portion of the corresponding one of the tufts of fibers of said loop extend around a same loop of a successive course of the knitted base material.

* * * * *